US005155973A

United States Patent [19]

Hipko et al.

[11] Patent Number: 5,155,973

[45] Date of Patent: Oct. 20, 1992

[54] COMPOSITE WRAP AND METHOD FOR WRAPPING MULTI-PAGE ITEMS

[75] Inventors: George P. Hipko, Milltown; Frederick Grainger, Greenbrook, both of N.J.

[73] Assignee: Webcraft Technologies, Inc., North Brunswick, N.J.

[21] Appl. No.: 699,604

[22] Filed: May 14, 1991

[51] Int. Cl.[5] ..... B65B 11/50

[52] U.S. Cl. ..... 53/452; 53/450; 53/460

[58] Field of Search ..... 53/460, 452, 553, 450, 53/456, 469

[56] References Cited

U.S. PATENT DOCUMENTS

| | | | |
|---|---|---|---|
| 2,226,442 | 12/1940 | Rumsey, Jr. | 17/32 |
| 3,017,795 | 1/1962 | Joa | 83/129 |
| 3,234,705 | 2/1966 | Schwartz | 53/553 X |
| 3,289,386 | 12/1966 | Farmer | 53/28 |
| 3,313,086 | 4/1967 | Johansson | 53/228 |
| 3,411,263 | 11/1968 | Smolderen | 53/553 X |
| 3,628,304 | 12/1971 | Hornung | 53/460 |
| 3,782,067 | 1/1974 | Smolderen | 53/209 X |
| 3,808,768 | 5/1974 | Dobbs | 53/460 |
| 4,369,613 | 1/1983 | Gess | 53/553 |
| 4,769,969 | 9/1988 | Minami | 53/553 X |

*Primary Examiner*—James F. Coan

*Attorney, Agent, or Firm*—Shlesinger Arkwright & Garvey

[57] ABSTRACT

A first envelope having means for forming a large flap thereon for displaying advertising indicia or coupons thereon and forming the flap on a flat conveyor. The invention also includes providing selective inserts and a vacuum-assisted rotary feeder for placing insert samples on the conveyor. The envelope may be formed initially using a single web divided into a base web portion having bottom and top flaps and a cover web portion. The envelope may also be formed using a first web having top and bottom flaps and a second cover web made of transparent material so that the inserts and samples located within the package may be viewed through the wrapper.

15 Claims, 5 Drawing Sheets

COMPOSITE WRAP AND METHOD FOR WRAPPING MULTI-PAGE ITEMS

FIELD OF THE INVENTION

The present invention relates to a two-piece envelope for wrapping insert sheets and sample packets.

BACKGROUND OF THE INVENTION

Composite envelopes are used when it is desirable to wrap a large number of sheets or magazines in an envelope and for holding of advertising indicia or a removable packet.

Prior large flap envelopes having inserts required a ribbon placed about the inserts to hold them in place during folding of the large flap. This was due to the requirement for an inclined conveyor to enable the large flap to be formed. When the web was inclined in this procedure, the inserts placed upon the web would tend to slide off without some means of support, resulting in a shutdown of the assembly system while the inserts were restacked. The use of a ribbon to hold the inserts in place solved this problem but added an extra step to the procedure.

The use of two separate webs to form a package is known and generally described in the U.S. Pat. No. 3,411,263 of Smolderen. However, Smolderen is directed to a sealed package to prevent the entrance of light therein and does not recognize the advantage of applying a transparent cover layer to the first web to allow an individual to visually observe the interior contents of the package. Smolderen also does not account for variable thicknesses of his package.

In view of the foregoing it can be seen that there is a need for a new envelope and method and apparatus for its construction where in a single web can be used and separated into the first web and the second web to create a base web having bottom and top flaps and a cover web which allows the envelope to be readily formed on a flat conveyor. It can also be seen that an envelope formed of a lower wrap web and an upper web by the described method and apparatus can be used to make an envelope having a transparent wall for viewing the contents held therein.

FEATURES AND SUMMARY OF THE INVENTION

An important feature of this invention is to provide an envelope which can be formed around a stack of material on a flat conveyor.

Another feature of the invention is to provide a large flap envelope for containing inserts and being formable on a flat conveyor.

Yet another feature of the invention is to provide an envelope formed of two pieces having a cover piece overlapping a bottom flap of the envelope and a cover flap overlapping the cover piece of the envelope.

Still another feature of the invention is to provide a series of preformed fold lines in the envelope to form boxed top and bottom ends.

Still another feature of the invention is to provide an apparatus and method for constructing the before mentioned envelope in a continuous process from a single web.

Yet another feature of the invention is to provide means for selectively determining the insert materials for each envelope formed on the continuous conveyor system.

Still another feature of the invention is to provide a vacuum-operated rotary feed conveyor for placing sample inserts on the flat conveyor.

Another feature of the invention is to provide a two-piece envelope having a transparent wall formed therein for permitting visual inspection of the contents of the envelope.

Still another feature of the invention is to provide a method and apparatus for forming the above-mentioned envelope having a transparent wall.

Still another feature of the invention is to provide selective feeders for placing selective inserts on a flat conveyor and transferring the inserts to the flat envelope forming conveyor.

Yet another feature of the invention is to provide feeder for placing insert samples on the stack of selected inserts.

In summary, therefore, the invention is directed to a first envelope having means for forming a large flap thereon for displaying advertising indicia or coupons thereon and forming the flap on a flat conveyor. The invention also includes providing selective inserts and a vacuum-assisted rotary feeder for placing insert samples on the conveyor. The envelope may be formed initially using a single web divided into a base web portion having bottom and top flaps and a cover web portion. The envelope may also be formed using a first web having top and bottom flaps and a second cover web made of transparent material so that the inserts and samples located within the package may be viewed through the wrapper.

In both methods, inserts may be selectively inserted onto the base web for filling the envelope. The inserts may also include a sample product by itself or in a container for packaging by itself or with other insert sheets.

In both methods the bottom flap and top flap are formed with a double fold so that a box end is formed at both the top and the bottom of the envelope.

The foregoing invention will be further described in regard to the accompanying drawings.

DETAILED DESCRIPTION OF THE INVENTION

Figure 1:
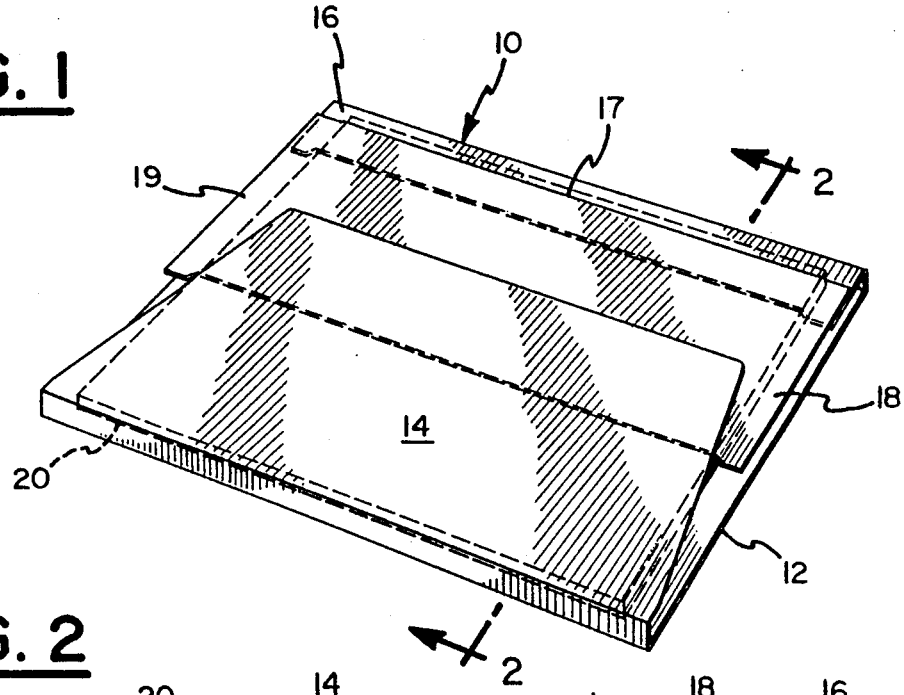
FIG. 1 is an envelope constructed in accordance with the invention.

In FIG. 1 an envelope 10 is shown having a base sheet 12, a top cover flap 14, a bottom end flap 16. A top cover sheet 17 having side edges 18 and 19 is adhesively joined to base sheet 12. A group of inserts 20 are shown held within the envelope 10. A cross-section of the envelope 10, taken along lines 2—2 of FIG. 1 is shown in FIG. 2.

Figure 2:
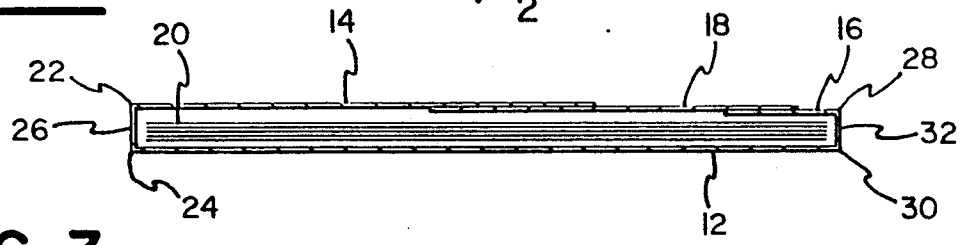
FIG. 2 is a cross-section taken along lines 2—2 of the envelope of FIG. 1.

In FIG. 2 the base sheet 12 is shown having a top cover flap 14 and bottom end flap 16. Top cover flap 14 is formed with a pair of fold lines 22 and 24 so that a wall 26 extending substantially vertically from base sheet 12 is formed when the envelope is folded to form a box end.

Bottom end flap 16 includes a pair of fold lines 28 and 30 so that a substantially vertical end wall 32 is formed when bottom end flap 16 is folded.

As shown, top cover sheet 18 overlaps flap 16 and is overlapped by flap 14.

Figure 3:
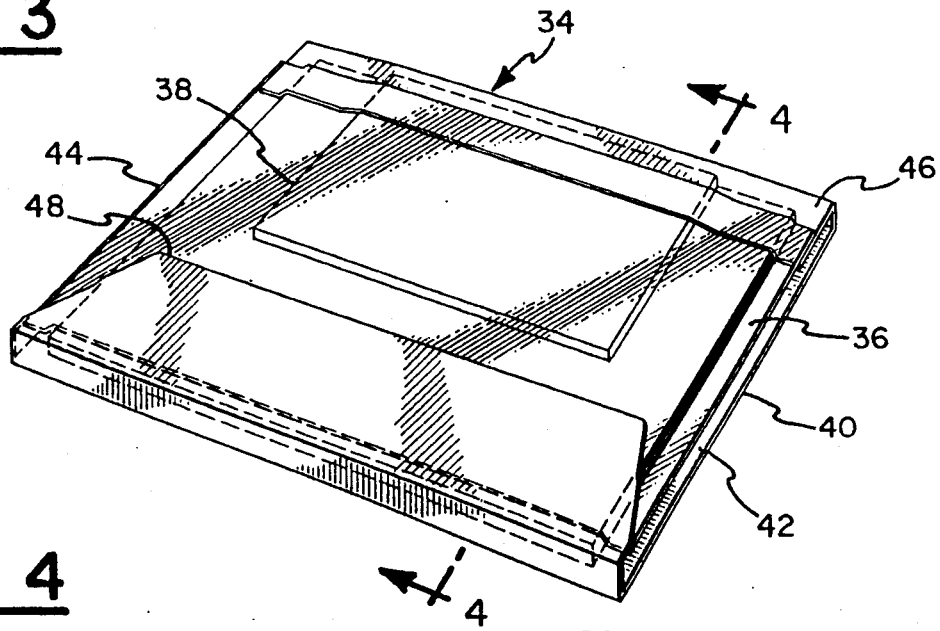
FIG. 3 is an envelope formed with a transparent panel.

FIG. 3 shows envelope 34 having a transparent cover sheet 36 for viewing the interior contents such as inserts or a packet 38. Transparent cover sheet 36 is preferably joined to base sheet 40 along the side edges 42 and 44. Bottom flap 46 and top flap 48 are joined in a similar manner to bottom flap 16 and top flap 14 of FIG. 1. Bottom flap 46 is located beneath cover sheet 36 and top flap 48 overlaps cover sheet 36.

Figure 4:
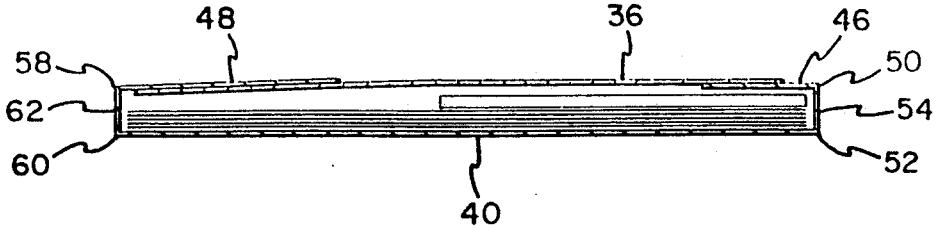
FIG. 4 is a cross-sectional view of the envelope of FIG. 3 taken along lines 4—4 and showing a packet enclosed therein.

FIG. 4 is a cross-section taken along lines 4—4 of FIG. 3. Bottom end flap 46 is separated from base sheet 40 by a pair of fold lines 50 and 52. Fold lines 50 and 52 are spaced apart sufficiently to create a box end wall 54 there between extending substantially perpendicularly to the bottom flap 46 and the base sheet 40 when flap 46 is folded. Top flap 48 is separated from back cover sheet 40 by a pair of spaced apart fold lines 58 and 60 which form a wall 62 substantially perpendicular to top flap 48 and base sheet 40 when top flap 48 is folded.

Figure 5:
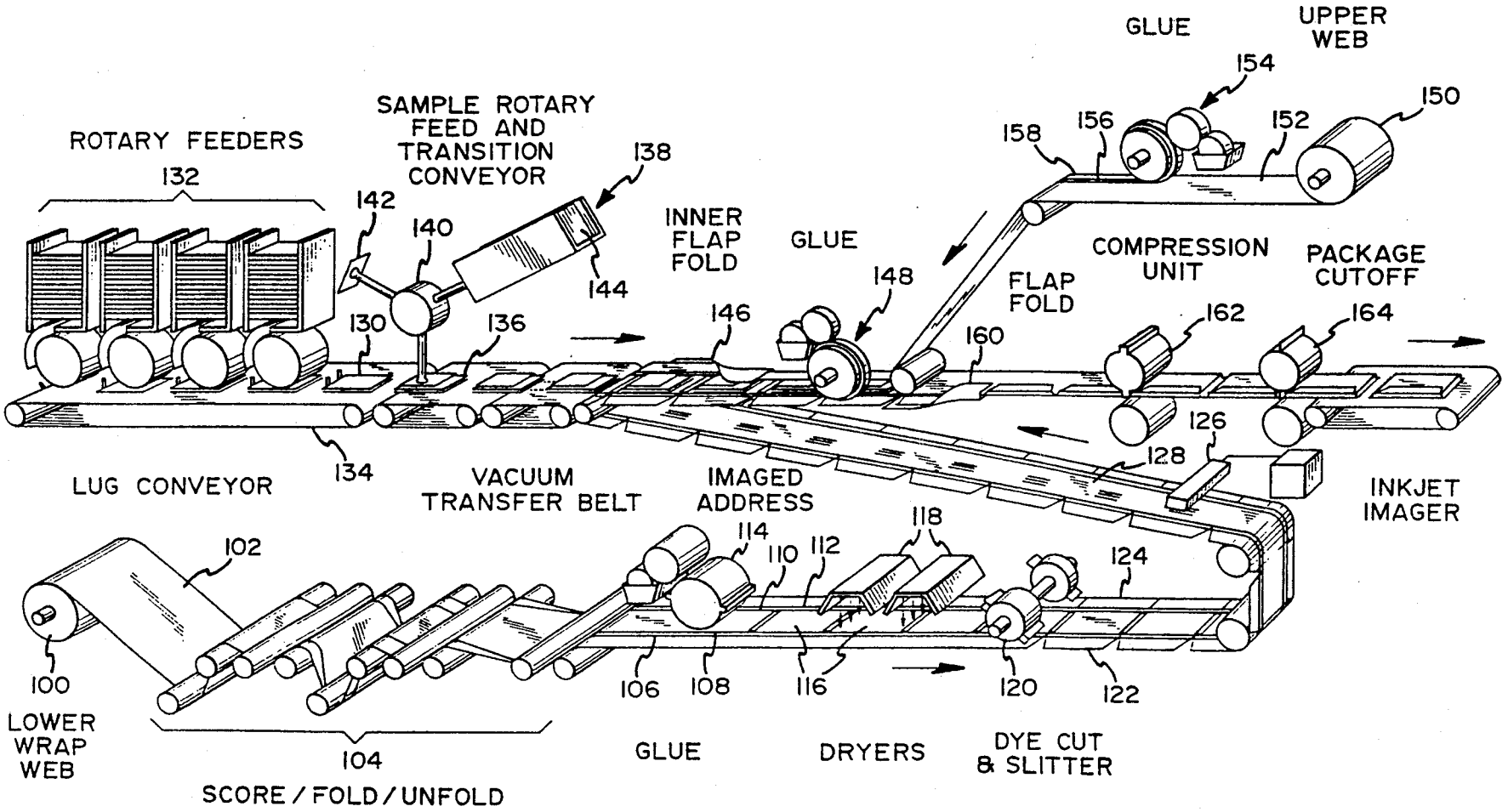
FIG. 5 is a schematic view of the apparatus for forming the large flap insert sampler envelope using two separate webs.

FIG. 5 shows an envelope forming and filling assembly. A first web 100 delivers a continuous web of paper or other sheet material 102 to a series of scoring, folding and unfolding rollers 104 which form scored fold lines 106, 108, 110 and 112 in the web of sheet material 102.

After the folds 106, 108, 110 and 112 have been formed in the web sheet 102, adhesive is applied preferably by a rotating assembly 114 which applies glue at spaced apart locations along the web 102 demarcating individual envelope sections 116. The glue applied is preferably a pressure sensitive adhesive variety and is dried prior to further processing by dryers 118 located downstream of the glue application assembly 114. Dryers 118 are preferably conventional such as infrared, however other dryers known in the art may be used.

After passing the dryers 118, a combination die-cut and slitter 120 creates top and bottom flaps 122 and 124, respectively for each of the individual envelope sections 116.

While the web 102 is traveling along its path, an inkjet imager 126 places the intended recipient's address on the face 128 of each envelope section 116.

During the preparation of the web sheet 102, a set of inserts 130 is prepared which corresponds to the recipient identified by the inkjet imager. A series of selective feeders 132 are located along conveyor 134 to place selected inserts in a stack 136 according to each individual's demographic information which is tied in with the logic circuit of the inkjet imager 126.

Also shown in FIG. 5 is a packet feeder 138 which uses a vacuum-assisted rotary feeder 140 to remove a packet 142 from a stack 144 and place the packet 142 on insert stack 136 on conveyer 134.

As previously stated, the selected inserts 136 and packet 142 are selectively positioned along the conveyor 134 in order that the stack is matched up with a corresponding envelope section 116 which has been preaddressed to a selected individual. It should be understood that individual is used in the sense that it could be a corporation, business, or other special interest group as well as an individual person.

After placement of the packet 142 on the insert stack 136, the stack is moved along conveyor 134 and is placed on top of its corresponding envelope section 116. A vacuum transfer belt is commonly used on the conveyor 134 to aid in pushing the stack 136 onto section 116. Bottom flap 124 of the envelope section 116 is then folded over, preferably through the use of a plow fold mechanism 146. Next, glue or other adhesive is applied to the top surface of top flap 122 of envelope section 116 using an adhesive roller system 148.

A second web roll 150 dispenses a web of sheet material 152 to an adhesive application unit 154 which applies adhesive 156 along a first edge 158 of the web 152. Preferably, web 152 is transparent material such as cellophane, polyethylene, etc.

After application of the adhesive strip 156, the web 152 is brought into contact with bottom flap 124 and is adhered thereto along edge 158.

Then top flap 122 is folded over using a plow fold 160 and is adhered to web 152.

A compression unit 162 then applies pressure between each envelope section 128 to adhere second web 152 to web sheet 102 along glue strips 115. A cutter 164 then separates the envelope sections into individual packages by severing the first web 102 and the second web 152.

Figure 6:
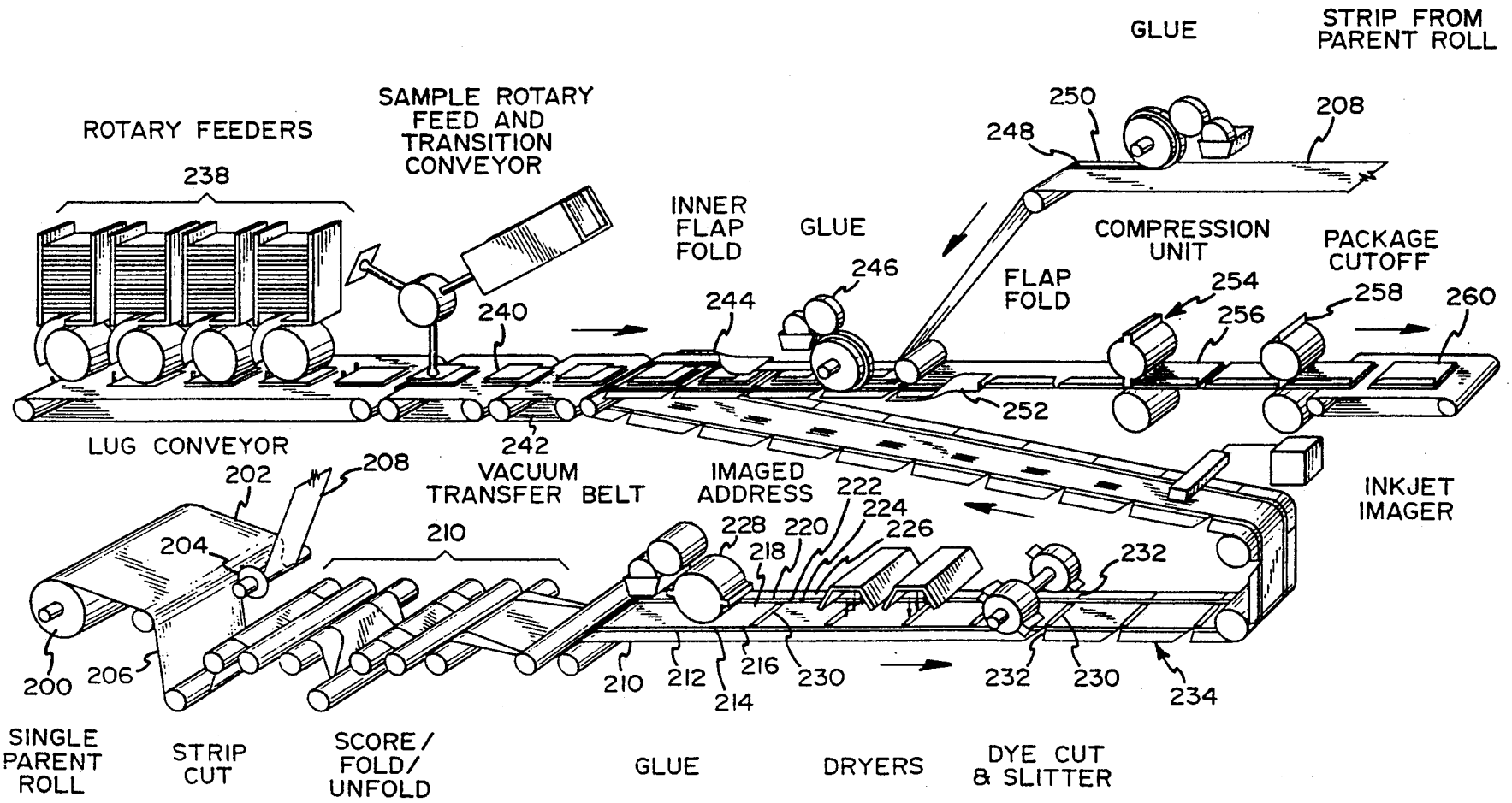
FIG. 6 is a schematic diagram showing the construction of the large flap insert sampler envelope from a single web.

Now referring to FIG. 6, web roll 200 dispenses a web of sheet material 202 such as paper or plastic, for example. Web 202 is first separated using a slitter 204 to separate the web 202 into a base web 206 and a cover web 208. The cover web 208 is moved out of the way and repositioned for application to the base web 206 at a later stage of the assembly process.

Base web 206 is then passed through a series of scoring, folding and unfolding rollers 210 which creates a top flap 210, a first fold line 212, a first end panel 214 and a second fold line 216, a central panel 218, a third fold line 220, a second end panel 222, a fourth fold line 224 and a bottom flap 226.

An adhesive applicator 228 applies spaced double strips 230 of adhesive across the central panel 218 of web sheet 202 perpendicularly to the path of travel of the web 202. A dryer assembly as previously described then dries the pressure sensitive adhesive on the moving base web 206. After passing the dryer a die-cut and slitter cuts the base web 206 at the ends 232 of double adhesive strips 230 to create separations between the top and bottom flaps 210 and 226, respectively of individual envelope sections 234.

An inkjet imager then applies individual addresses from a predetermined list to the side of each envelope section 234 which will be exposed for mailing. The address corresponds to the demographic information concerning each individual customer as previously described and is used in conjunction with the selective feeder assembly 238 as previously described in regard to FIG. 5.

The stack of preselected inserts 240 is then moved from the conveyor 242 and placed upon its corresponding envelope section 234 of base web 206. A plow fold 244 folds over bottom flap 226 to create a box end fold.

Adhesive is then applied to top flap 210 by adhesive applicator 246.

Next cover web 208 has a strip of glue 248 applied thereto along an edge 250. Cover web 208 is brought into contact with bottom flap 226. A second plow fold 252 then folds top flap 210 to overlap cover web 208 and is adhered thereto. A compression unit 254 then joins the cover web 208 to the double adhesive strips 230 to create individual envelope units 256. A package cutoff 258 separates the envelope sections by severing between the double strips of adhesive 230 to create individual envelopes 260.

Figure 7:
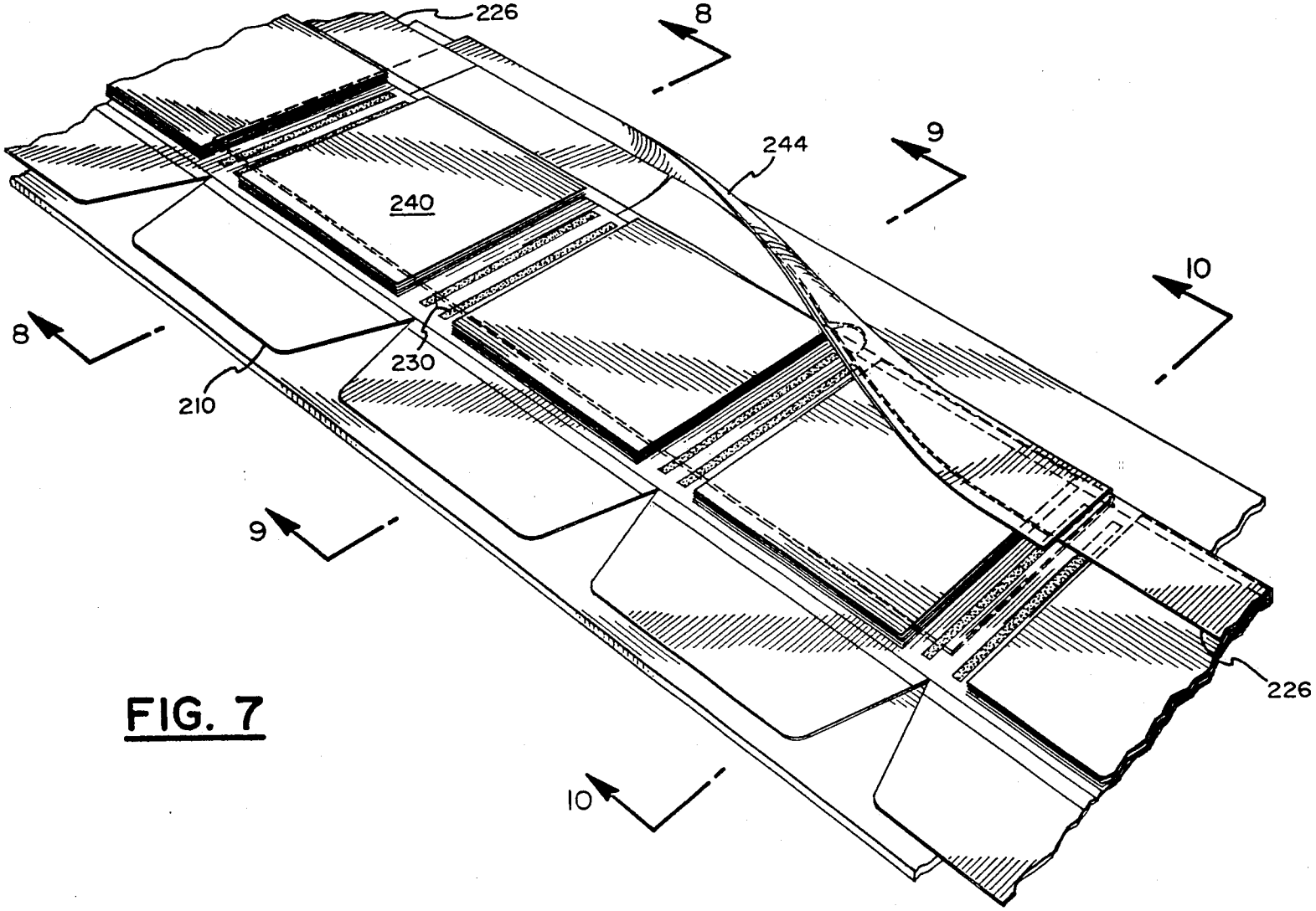
FIG. 7 is a perspective view of the bottom flap former folding the bottom flap over a set of inserts in each of the envelope spaces of the base web.
Figure 8:
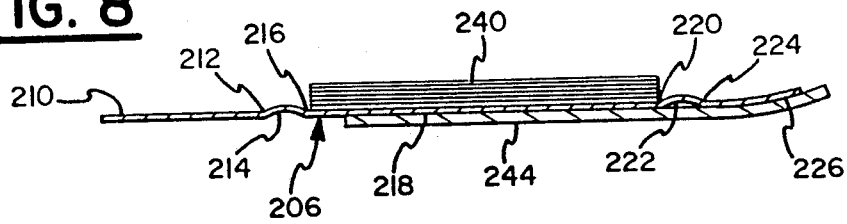
FIGS. 8–10 show cross-sections of the folding sequence of the bottom edge of the envelope taken along lines 8—8, 9—9, and 10—10, respectively; and, FIGS. 11 and 12 illustrate envelopes of different thicknesses showing the proportionately enlarged adhesive area in comparison to package thickness.

FIG. 7 illustrates the folding sequence for the bottom flap to create the box end fold. Sections of the sequence taken along lines 8—8, 9—9, and 10—10 show the various stages of the folding sequence. Referring now to FIG. 8, the base web 206 is shown having a stack of inserts 240 located thereon. Base web 206 includes a top flap 210, the first fold line 212, an end panel 214 located between the first fold line 212 and the second fold line 216. A central panel 218 supports the inserts 240 during formation of the envelope. An end panel 222 is formed between a third fold line 220 and a fourth fold line 224 between central panel 218 and bottom flap 226.

Figure 9:
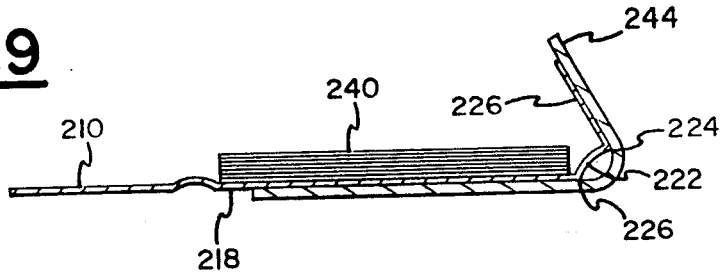

FIG. 9 shows the beginning of the plow fold wherein bottom flap 226 is being folded upwardly to overlap the insert stack 240.

Figure 10:
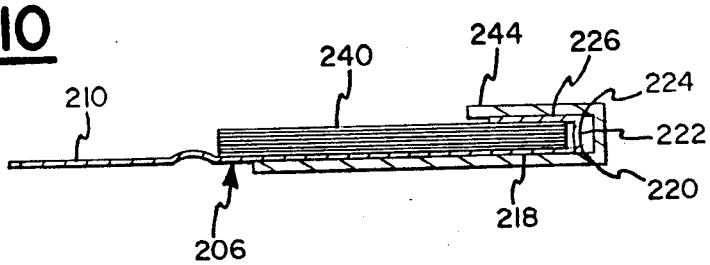

FIG. 10 shows the completed fold forming a box end with the bottom flap 226 lying substantially parallel to the central panel 218. The two fold lines 220 and 224 allow for substantially perpendicular angles between the bottom flap 226 and the end panel 222 as well as between the end panel 222 and the central panel 218. The folding sequence for the top flap 210 operates substantially the same way after the cover web 208 has been applied to overlap the insert stack 240 and bottom flap 226.

Figure 11:
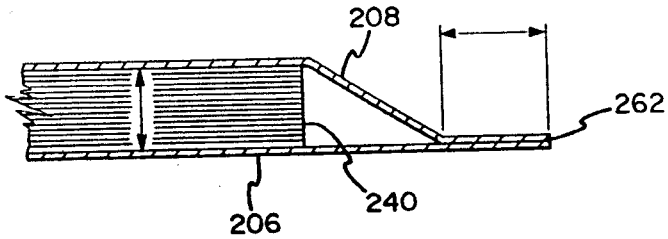
Figure 12:
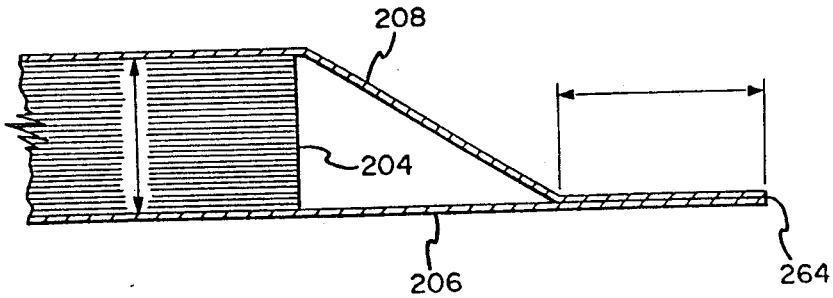

FIGS. 11 and 12 show the comparison between a thicker package and a thinner package and their corresponding adhesive areas required to maintain a seal along the edges 262 and 264, respectively. In general, packages over a ¼ inch thick should have an outer wrap extending past the insert stack 240 by at least 1 inch on each side. When the insert stack is over ½ inch thick, the outer wrap should extend past the insert stack about 2 inches on each side. For the thicker packages (over ¼ inch) the use of the separate upper web as shown in FIG. 5 is preferred to compensate for the difference in web length to wrap the internal package and seal the ends.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

We claim:

1. A method of making an envelope, comprising the steps of:

a) supplying a first web of stock material;

b) slitting said first web to form a base web and a cover web;

c) forming fold lines in said base web delineating top and bottom flaps to provide a flat sided paper package;

d) folding said base web to form a bottom flap;

e) placing said cover web on said base web and overlapping said bottom flap;

f) joining said cover web to said bottom flap;

g) folding said base web to form a top flap and joining said top flap to said cover web;

h) joining portions of said cover web to said base web to form discrete envelope sections; and, i) whereby, severing of the joined base web and cover web forms separate envelopes.

2. The method of making an envelope as set forth in claim 1, further comprising:

a) placing inserts on said base web prior to application of said cover web.

3. The method of making an envelope as set forth in claim 2, wherein:

a) placing said inserts on said base web includes placing at least one packet on said base web prior to application of said cover web.

4. The method of making an envelope as set forth in claim 1, wherein:

a) forming fold lines in said base web includes scoring and folding a pair of spaced apart parallel fold lines delineating the top flap from a central panel;

b) forming a pair of substantially parallel spaced apart fold lines delineating said bottom flaps from said central panel; and, c) whereby folding of said bottom flaps and said top flaps forms a box end unit at the top end and the bottom end of said central panel.

5. The method of making an envelope as set forth in claim 1, wherein:

a) moving said base web along a predetermined path and forming said envelope as said base web moves along said predetermined path; and, b) applying spaced apart strips of adhesive to said base web oriented perpendicularly to the predetermined path of travel.

6. The method of making an envelope as set forth in claim 5, wherein:

a) joining portions of said cover web to said base web to form discrete envelope sections includes joining said cover web to said adhesive strips of said base web.

7. The method of making an envelope as set forth in claim 6, wherein:

a) said adhesive strips are applied in slightly spaced apart pairs; and, b) whereby, severing of the joined based web and cover web occurs between said slightly spaced apart pairs of adhesive strips.

8. A method of making an envelope, comprising the steps of:

a) supplying a base web of stock material;

b) forming fold lines in said base web delineating top and bottom flaps and a central panel and to provide a flat sided paper package;

c) folding said bottom flap over said central panel;

d) supplying a transparent cover web;

e) placing said cover web on said base web and overlapping said bottom flap;

f) joining said cover web to said bottom flap;

g) folding said base web to form a top flap and joining said top flap to said cover web;

h) joining portions of said cover web to said base web to form discrete envelope sections; and, i) whereby, severing of the joined base web and cover web forms separate envelopes.

9. The method of making an envelope as set forth in claim 8, further comprising:

a) placing inserts on said base web prior to application of said cover web.

10. The method of making an envelope as set forth in claim 9, wherein:

a) placing said inserts on said base web includes placing at least one packet on said base web prior to application of said cover web.

11. The method of making an envelope as set forth in claim 9, wherein:

a) forming fold lines in said base web includes scoring and folding a pair of spaced apart parallel fold lines delineating the top flap from said central panel;

b) forming a pair of substantially parallel spaced apart fold lines delineating said bottom flaps from said central panel; and, c) whereby folding of said bottom flap and said top flap forms a box end unit at each of the top flap end and at the bottom flap end of said central panel.

12. The method of making an envelope as set forth in claim 9, wherein:

a) moving said base web along a predetermined path and forming said envelope as said base web moves along said predetermined path; and, b) applying at spaced apart strips of adhesive to said base web oriented perpendicularly to the predetermined path of travel.

13. The method of making an envelope as set forth in claim 12, wherein:

a) joining portions of said cover web to said base web to form discrete envelope sections includes joining said cover web to said adhesive strips of said base web.

14. The method of making an envelope as set forth in claim 13, wherein:

a) said adhesive strips are applied in slightly spaced apart pairs;

b) whereby, severing of the joined based web and cover web occurs between said slightly spaced apart pairs of adhesive strips.

15. A method of making an envelope comprising the steps of:

a) supplying a base web of stock material;

b) forming fold lines in said base web delineating top and bottom flaps to provide a flat sided paper package;

c) supplying a stack of preselected inserts to said base web;

d) folding said base web to form a bottom flap;

e) supplying a cover web;

f) placing said cover web over said inserts on said base web and overlapping said bottom flap;

g) joining said cover web to said bottom flap;

h) folding said base web to form a top flap and joining said top flap to said cover web; and, i) joining side portions of said cover web to said base web to form an envelope.

* * * * *